United States Patent [19]

Hardouin

[11] Patent Number: 4,862,728

[45] Date of Patent: Sep. 5, 1989

[54] EXTRUSION DIES

[75] Inventor: Jean-Pierre Hardouin, Luisant, France

[73] Assignee: Alcan International Limited, Montreal, Canada

[21] Appl. No.: 159,461

[22] Filed: Feb. 19, 1988

Related U.S. Application Data

[63] Continuation of Ser. No. 807,292, Dec. 10, 1985, abandoned.

[30] Foreign Application Priority Data

Dec. 14, 1984 [GB] United Kingdom ..... 8431667

[51] Int. Cl.[4] ..... B21C 25/02

[52] U.S. Cl. ..... 72/467; 72/253.1

[58] Field of Search ..... 72/467, 253.1, 272, 72/271, 264

[56] References Cited

U.S. PATENT DOCUMENTS

| | | | |
|---|---|---|---|
| 1,840,472 | 1/1932 | Singer | 72/272 |
| 2,559,523 | 7/1951 | Templin | 72/467 |
| 2,671,559 | 3/1954 | Rosenkrantz | 72/467 |
| 3,364,718 | 1/1968 | Green | 72/467 |
| 4,064,723 | 12/1977 | Larsson et al. | 72/272 |

FOREIGN PATENT DOCUMENTS

| | | | |
|---|---|---|---|
| 536629 | 4/1932 | Fed. Rep. of Germany | 72/467 |
| 560186 | 9/1932 | Fed. Rep. of Germany | 72/467 |
| 343877 | 4/1904 | France | 72/467 |
| 1075241 | 10/1954 | France | 72/253.1 |
| 13532 | 2/1973 | Japan | 72/467 |

OTHER PUBLICATIONS

*Aluminum vol. III, Fabrication and Finishing,* from American Society for Metals, Metals Park, Ohio, 1967, pp. 91, 92.

Akeret, R., "Influence of Cross-Sectional Shape and Die Design in Extrusion of Aluminum Part II Friction in the Die Land" from *Aluminum,* vol. 59, No. 10, 1983, pp. E355-60.

Bello, L. B., *Aluminum Extrusion Die Correction,* 1st Ed., Fellom Puplications, San Francisco, page Bearing FIG. 27.

Pearson, C. E. et al., *The Extrusion of Metals,* Second Edition, John Wiley & Sons, Inc., New York, N.Y., 1960, pp. 195, 196.

Pearson, C. E. et al. *The Extrusion of Metals,* Second Editon, John Wiley & Sons, Inc., New York, N.Y., 1960, pp. 113-115.

*Primary Examiner*—Daniel C. Crane

*Attorney, Agent, or Firm*—Cooper & Dunham

[57] ABSTRACT

An extrusion die has a die aperture which is negatively tapered essentially throughout its length at an angle of at least 1° such that any friction stress between the die lands and metal flowing through them is negligible, the length of the lands being not more than 2 mm so that fouling does not significantly take place thereon during extrusion. Faster extrusion speeds can be achieved, particularly when extruding aluminium alloy having a shear strength of from 1.2 to 4.0 Kg/mm$^2$ at 500° C.

5 Claims, 2 Drawing Sheets

EXTRUSION DIES

This is a continuation continuation-in-part of application Ser. No. 06/807,292, filed Dec. 10, 1985 now abandoned.

This invention relates to extrusion dies. It provides a radically new approach to their design, as a result of which metals, particularly aluminium and magnesium alloys, can be extruded faster and the service life of the dies can be increased.

In the accompanying drawings.

Figure 1:
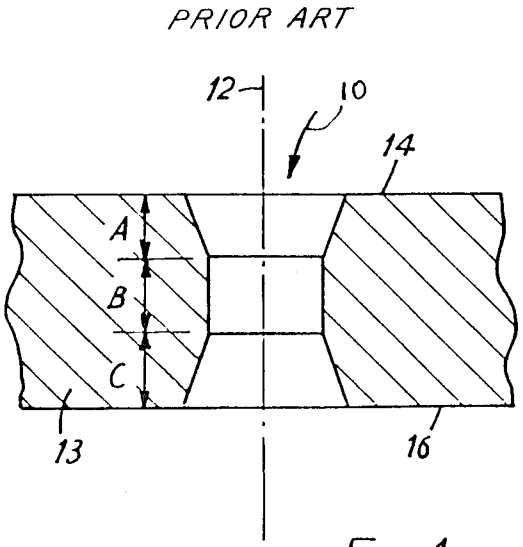
FIG. 1 is a section through a conventional extrusion die.

Referring to FIG. 1, the extrusion process involves forcing metal in the direction of the arrow 10 through an aperture (die) having an axis 12 in a die plate 3 having an upstream face 14 perpendicular to the axis and a downstream face 16. A conventional extrusion die may be designed to have parallel sides. However, in practice such dies may often be considered as including three sections, although not all of these would necessarily be present to any significant extent in any particular die. These sections are an initial choked section A adjacent the upstream face in which the crosssectional area of the die decreases in the direction of metal flow; an intermediate section B where the die lands on opposite sides of the aperture are substantially parallel and the cross-sectional area of the die remains essentially constant in the direction of metal flow; and a final opening section C adjacent the downstream face in which the cross-sectional area increases in the direction of metal flow. The total length A plus B plus C is typically 3–30 mm, depending on the nature of the metal being extruded and other factors. Die design has for many years involved varying the relative lengths of sections A, B and C and the angles of taper of sections A and C. For example, it is well known that a pronounced choked section A slows metal flow; and that a small or negligible choked section A with a pronounced opening section C speeds metal flow. Indeed, on these factors is based the technique of die correction, by which the profile of part of a die is contoured to equalize metal flow rates through all parts of the die, or by which the profile of one die is contoured to equalize metal flow rates through all dies of a multi-aperture die plate.

Until the mid 1970's, die apertures used to be filed by hand and this generally resulted in apertures that were cambered and the lengths of both of sections A and C were substantial. More recently the development of wire spark erosion machines, with accurate control of wire position and angle and adequately high rates of erosion, have enabled die apertures to be cut with much greater precision.

In sections A and B of an aperture there is friction between the metal being extruded and the die plate. This causes wear to the die plate. It also heats the metal being extruded, sometimes to such an extent that local melting may occur, and this phenomenon may indeed set an upper limit on the possible extrusion speed. Additional pressure is required to overcome these frictional forces, over and above that required to cause metal to cross the upstream face of the die plate and enter the aperture; the die is said to have a positive pressure effect.

The present invention is based on the concept, believed entirely novel, of an extrusion die having a substantially zero pressure effect. To achieve this, the length of both of the sections A and B of the aperture needs to be substantially zero. The invention thus provides an extrusion die having a die aperture which is negatively tapered essentially throughout its length at an angle such that any friction stress between the die lands and metal flowing through them is negligible, the length of the lands being so small that fouling does not significantly take place thereon during extrusion.

Figure 2:
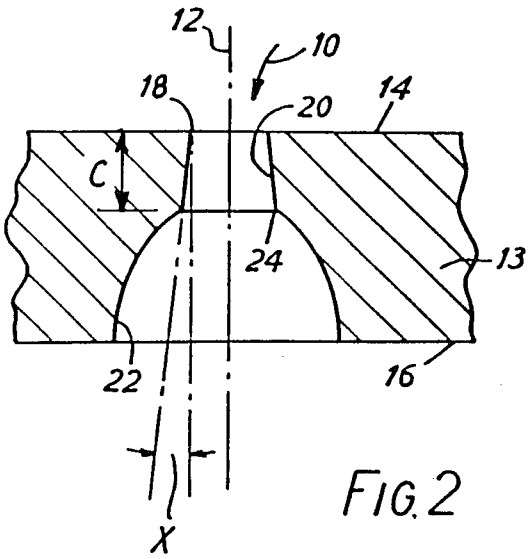
FIG. 2 is a corresponding section through an extrusion die according to the present invention.

FIG. 2 shows an extrusion die according to the invention including a die plate 13 having an upstream face 14 and a downstream face 16. An aperture has an axis 12 perpendicular to the upstream face of the plate. For extrusion, metal is forced through the die in the direction shown by the arrow 10.

The entrance of the die is defined by a substantially sharp corner 18. This corner should be as sharp as possible We prefer that the corner have a radius of curvature below 0.2 mm, ideally below 0.1 mm. If the corner is much blunter than this, then there is increased frictional drag and the surprising advantages of the die begin to be lost.

The die land 20 is shown as having a negative taper of X°. The value of X should be sufficiently great that there is no significant friction stress between the die land and metal flowing through it. If X is 0 (i.e. if the die land is parallel sided) then substantial frictional stress is found to exist. With increasing X, this stress falls rapidly, and reaches a value of about zero (when the extruded metal is aluminium or magnesium or an alloy thereof) when X is about 0.8°–1°. This is therefore a preferred minimum value of X. While there is no critical maximum value, it will be apparent that a high value of X would result in too sharp a corner at the entrance of the die aperture. It is unlikely that anyone would want to make a die plate in which X was more than about 25°.

The length C of the die land should be sufficiently short that fouling does not significantly take place thereon during extrusion. Fouling involves deposition of metal or oxide particles on the die land and subsequent pick-up of the particles by the extruded section and may prevent high speed extrusion after a few dozen passes.

In our experiments with alloys of A1, we have surprisingly found that fouling does not occur if the length of the die lands (i.e. the dimension C) is kept sufficiently small. The maximum permissible value of C, if fouling is to be avoided, appears to be related to the negative taper angle X, and to increase with increasing X. For example, when X is 1°, C should generally be not more than about 2 mm. But when X is 10°, C can safely be much greater and may suitable be around 18 mm. At high values of X, the extent of fouling is in any event much less. The die needs to be sufficiently strong to minimise flexing in use, and this generally requires a value for C of at least about 1.4 mm.

On the downstream side, the aperture is defined by a cambered depression 22 which connects with the downstream end of the die lands 20 at a corner 24. The shape of the depression is not critical to the invention and may be chosen in conjunction with the total thickness to provide a die plate having desired strength and rigidity. Although the die lands are shown as straight in the figure, they could have been curved, in such a way that the negative taper angle would have increased in the direction of flow. And the corner 24 joining the lands to the depression could have been rounded off.

The extrusion die can be made of any material, e.g. steel, normally used for such purposes. It can be nitrided to reduce wear in the same way as conventional extrusion dies. It can be used in conjunction with a feeder plate and/or a die holder as support. No modifications of equipment either upstream or downstream are necessary in order to use the new extrusion dies.

The design of the die is such that correction (i.e. modification of the profile of the aperture to hasten or slow the passage of metal) is hardly possible. So the die is mainly suitable for extruding sections whose configuration does not require adjustment or correction; this includes some 30–40% of all solid sections. The dies of the invention are also suitable, in conjunction with a mandrel, for extruding hollow sections. The surfaces of the mandrel which lie between the upstream face 14 and the downstream face 16 may be tapered in the same sense as the die lands 20, or be parallel to the axis 12 of the aperture.

The extrusion die may have a single aperture, or may have, as is common with conventional dies, 2 to 6 or even more apertures. Because there is no significant frictional drag in the die apertures, the extruded metal may emerge at the same speed from different apertures in the same die, even when the extruded sections have quite different shapes. Thus for a given multi-aperture die under given extrusion conditions, the extrusion speed through a given aperture should not depend on the shape of the extruded section, although it may depend on the position of the aperture in the die plate.

One result of our novel die design is that the extruded metal contacts the die aperture only over a very limited area, in the region of the corner 18 in FIG. 2. It follows that die wear is much less in the new dies than in conventional ones. We have further found that the propensity of the new dies to pick up dirt is much less than conventional ones. Thus, the extrusion dies of the invention can be used for longer, before removal for cleaning or for renitriding becomes necessary, than conventional dies.

Another major advantage of this invention is the increased speed at which extrusion can be effected. Economic factors require that extrusion presses operate at maximum throughput in terms of weight of metal extruded per hour. With this objective, the extrusion cycle is made as short as possible. The loading period (during which a fresh billet is loaded into the extrusion container) is reduced to a minimum, typically less than 30 seconds. If the extrusion die has to be changed, this is done during the loading period so as not to reduce throughput. The extrusion period is also reduced to a minimum by raising the speed of advance of the ram. An upper limit on the speed of advance of the ram is set by the need to achieve certain properties, e.g. surface finish and lack of tearing or distortion, in the extruded section. This invention is also applicable to continuous extrusion.

Figure 3:
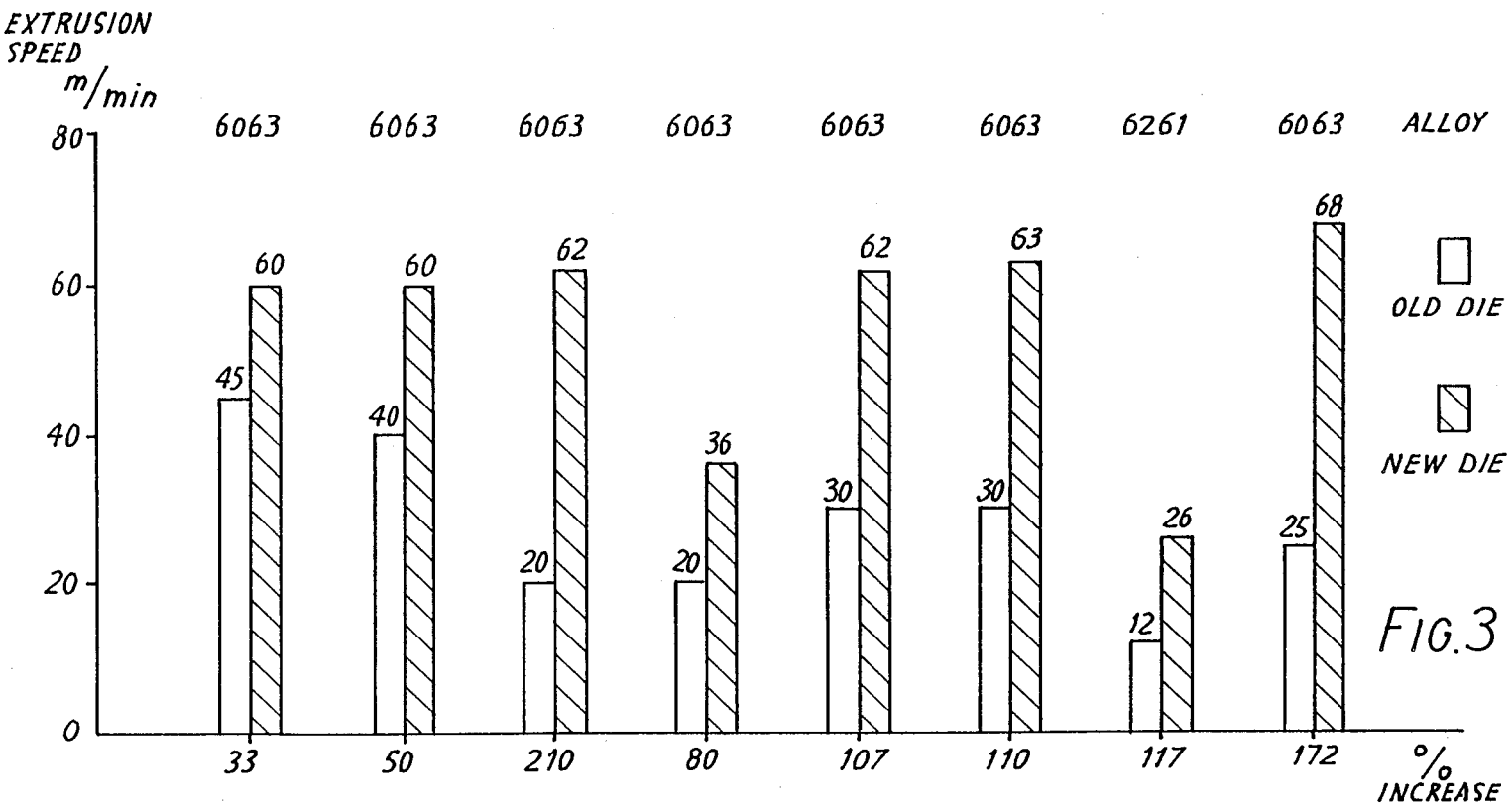
FIG. 3 is a diagram showing extrusion speeds obtainable for various extruded sections.

Reference is directed to FIG. 3 of the accompanying drawings. This relates to various extruded sections illustrated at the top, both solid sections and hollow ones. The vertical axis represents speed of travel in m/min. of the section from the die aperture. Below each section are two pillars; the pale left-hand one represents the maximum speed that can be achieved using a conventional extrusion die along the lines of that illustrated in FIG. 1; the dark right-hand one represents the maximum speed achieved using an extrusion die according to this invention. The figure at the top of each column represents the extrusion speed. The row of figures below the columns represents the percentage difference between the two. It can be seen that the improved extrusion speed achievable by means of the dies of this invention ranges from 33% to 210% depending on the shape of the section.

The experiments reported in Fiture 3 were (with one exception) performed using an Al/Mg alloy No. 6063 of the Aluminum Association Inc. Register, such as is generally used for extrusion. The following Example, performed using the same alloy, illustrates the improvements in wear-resistance and cleanliness noted above.

EXAMPLE

The metal was extruded to form an AR 1050S section (a rectangular tube 18×12×1 mm) using a conventional extrusion die (P) and a die according to this invention (Q). These results were obtained

| | P | Q |
|---|---|---|
| Maximum extrusion rate (m/min) | 25–30 | 50–60 |
| Number of billets extruded before die removed for cleaning | 40–50 | more than 280 |
| Life of die before re-nitriding necessary (no. of billets) | 150–200 | more than 1000 |

Although this invention is concerned with results and not with mechanisms, we suggest the following possible explanation for these dramatic improvements. During the extrusion process, heat is generated in two main ways:

(a) Re-shaping a billet into an extruded section involves shearing of the metal and this generates heat within the body of the metal and upstream of the extrusion die. To a limited extent, this heat can be removed by cooling the container in which the ram reciprocates, or by using a cooler billet. This heating effect may come to the metal surface and be responsible for the kind of pitting wear (known as "wash-out") that occurs towards the downstream faces of conventional extrusion dies.

(b) Friction between metal and the die aperture of a conventional die creates heat at this interface. To a limited extent, this heat can be removed by cooling the extrusion die, e.g. using water or liquid nitrogen.

Depending on the strength of the metal being extruded and on its melting point, one or other of these factors generally determines the maximum speed at which extrusion can be effected. These effects can be illustrated by reference to three different classes of metal:

(i) Pure aluminium has a rather low shear stress of about 1 $Kg/mm^2$ at 500° C. and a melting point of 660° C. Neither of factors (a) and (b) is limiting, with the result that it can be extruded at high speed through conventional dies. But the extruded sections are not very strong or tough.

(ii) High-strength alloys of aluminium with copper or zinc have a shear stress of 3.5–4.5 $Kg/mm^2$ or more at 500° C. and a solidus of around 570° C. For these alloys the extrusion rate-determining factor is (a) because of the large amount of work done on shearing the metal.

In both cases (i) and (ii), use of extrusion dies according to this invention is unlikely to permit any major increase in extrusion speed.

(iii) Medium strength alloys of aluminium, such as those with magnesium and silicon in the 6000 Series of the Aluminum Associates Inc. Register. These are the A1 alloys generally used for extrusion. They have a shear stress of 1.5–3.5 Kg/mm$^2$ at 500° C. and a solidus above 600° C. For these alloys the extrusion rate-determining factor is (b). The use of an extrusion die having a zero friction die aperture removes factor (b) as a source of heat and permits extrusion at faster speeds than is possible with conventional dies.

Thus this invention is particularly advantageous for extruding aluminium alloys having shear stress in the range 1.2–4.0, particularly 1.5–3.5, Kg/mm$^2$ at 500° C. However, the invention is not limited to the extrusion of such alloys. For example it is expected to be advantageous also in the extrusion of magnesium alloys where similar problems arise.

I claim:

1. In extrusion apparatus including an extrusion die having a die aperture laterally defined by lands and through which metal is extruded in a given direction, the improvement which comprises said aperture being negatively tapered throughout its length, with respect to said given direction, at an angle such that any friction stress between the lands and metal flowing through them is negligible, the length of the lands in said given direction being so small that fouling does not significantly take place thereon during extrusion, said angle being at least 0.8° and the upstream point of the negatively tapered aperture being defined by a corner having a radius of curvature not greater than 0.2 mm.

2. An extrusion die as claimed in claim 1, wherein the die aperture is negatively tapered at an angle of at least 1°.

3. An extrusion die as claimed in claim 1, wherein the length of the die lands is not more than 2 mm.

4. A method of extruding aluminium or magnesium or an alloy thereof by forcing the metal in a given direction through an extrusion die having a die aperture laterally defined by lands, said aperture being negatively tapered essentially throughout its length, with respect to said given direction, at an angle such that any friction stress between the lands and metal flowing through them is negligible, the length of the lands in said given direction being so small that fouling does not significantly take place thereon during extrusion, said angle being at least 0.8° and the upstream point of the negatively tapered aperture being defined by a corner having a radius of curvature not greater than 0.2 mm.

5. A method as claimed in claim 4 wherein the metal is an aluminium alloy having a shear strength of from 1.2 to 4.0 Kg/mm$^2$ at 500° C.

* * * * *